US010062940B2

(12) United States Patent
Liu et al.

(10) Patent No.: US 10,062,940 B2
(45) Date of Patent: Aug. 28, 2018

(54) DIELECTRIC PHASE SHIFTER COMPRISED OF A CAVITY HAVING AN ELONGATED RECEIVING SPACE WHERE A PHASE SHIFTING CIRCUIT AND A SLIDEABLE DIELECTRIC ELEMENT ARE DISPOSED

(71) Applicant: Comba Telecom Technology (Guangzhou) Ltd., Guangdong Province (CN)

(72) Inventors: Peitao Liu, Guangdong Province (CN); Guosheng Su, Guangdong Province (CN); Binlong Bu, Guangdong Province (CN); Fengzhang Xue, Guangdong Province (CN); Shanqiu Sun, Guangdong Province (CN)

( * ) Notice: Subject to any disclaimer, the term of this patent is extended or adjusted under 35 U.S.C. 154(b) by 0 days.

(21) Appl. No.: 15/122,995

(22) PCT Filed: Jan. 27, 2015

(86) PCT No.: PCT/CN2015/071659
§ 371 (c)(1),
(2) Date: Sep. 1, 2016

(87) PCT Pub. No.: WO2015/176552
PCT Pub. Date: Nov. 26, 2015

(65) Prior Publication Data

US 2017/0069941 A1 Mar. 9, 2017

(30) Foreign Application Priority Data

May 23, 2014 (CN) ..... 2014 1 0223020

(51) Int. Cl.
*H01P 1/18* (2006.01)
*H01Q 3/32* (2006.01)

(52) U.S. Cl.
CPC ..... *H01P 1/184* (2013.01); *H01P 1/18* (2013.01); *H01P 1/182* (2013.01); *H01Q 3/32* (2013.01)

(58) Field of Classification Search
CPC ..... H01P 1/184; H01P 1/18; H01P 9/00
(Continued)

(56) References Cited

U.S. PATENT DOCUMENTS 3,440,573 A * 4/1969 Butler ..... H01P 1/183 333/156
5,905,462 A * 5/1999 Hampel et al. ..... H01Q 3/26 333/159
2012/0287006 A1 11/2012 Lenormand et al.

FOREIGN PATENT DOCUMENTS

CN 2872609 2/2007
CN 1030 50747 4/2013
(Continued)

*Primary Examiner* — Benny Lee
(74) *Attorney, Agent, or Firm* — John W. Powell; Verrill Dana, LLP

(57) ABSTRACT

A dielectric phase shifter comprises a cavity having an elongated receiving space, a phase shifting circuit disposed inside the receiving space, and a dielectric element slidably mounted in the receiving space and parallel with the phase shifting circuit. A rail is disposed on an inner wall of the cavity for preventing contact between the movable dielectric element and the phase shifting circuit. By providing a number of rails between the phase shifting circuit and the dielectric element, direct contact between the dielectric element and a feeding network is prevented. As a result, no additional force will be imposed on the feeding network and reliability is enhanced. Moreover, wear of the feeding network and/or dielectric element during operation of the phase shifter is eliminated.

8 Claims, 6 Drawing Sheets

(58) Field of Classification Search
USPC ..... 333/161
See application file for complete search history.

(56) References Cited

FOREIGN PATENT DOCUMENTS

| | | |
|---|---|---|
| CN | 104051821 | 9/2014 |
| CN | 203950891 | 11/2014 |
| JP | 2002 158 502 | 5/2002 |

* cited by examiner

DIELECTRIC PHASE SHIFTER COMPRISED OF A CAVITY HAVING AN ELONGATED RECEIVING SPACE WHERE A PHASE SHIFTING CIRCUIT AND A SLIDEABLE DIELECTRIC ELEMENT ARE DISPOSED

CROSS-REFERENCE TO RELATED APPLICATIONS

This application is the US National Stage of International Application No. PCT/CN2015/071659 filed on Jan. 27, 2015, which claims the priority of the May 23, 2014 Chinese Application No. 201410223020.5. The contents of each of the above-referenced application is incorporated herein by reference in its entirety.

FIELD OF THE INVENTION

The present invention relates to a technical field of communication components and more particularly, relates to a dielectric phase shifter.

BACKGROUND OF THE INVENTION

In the field of mobile communication network coverage, an electrical tilt antenna for a base station is one of many important devices for realizing network coverage. In addition, a phase shifter is the most important component of the base station electrical tilt antenna. The quality of the phase shifter has direct influence on performance of the electrical tilt antenna, and has further influence on coverage quality of the network. As a result, it is manifest that the phase shifter plays a key role in the field of mobile base station antenna.

For prior art phase shifters, there are two conventional means to realize phase shifting. One way is achieved by changing the electrical length of a signal path inside the phase shifter, and the other way is achieved by moving dielectric material inside the phase shifter, thus further changing transmission velocity of signal in the phase shifter, thereby continuous linear phase difference for the signal output from the phase shifter is being generated. As such, the phase shifting is realized.

However, a prior art phase shifter realizing phase shifting by loading a dielectric element has the following problems.

First, the dielectric element directly contacts the feeding network and as a result, during long-term movement, friction will exist between the dielectric element and feeding network, thereby influencing performance of circuit.

Second, when the dielectric element contacts the feeding network, especially when the element is directly disposed on the feeding network, force will be imposed on the network. This not only jeopardizes structural reliability of the phase shifter, but also introduces passive inter-modulation product.

SUMMARY OF THE INVENTION

The object of the present invention is to provide a dielectric phase shifter for overcoming the disadvantages of prior art phase shifters, and to improve electrical performance and physical features.

To achieve the object, the following technical solution is provided.

A dielectric phase shifter comprises a cavity having an elongated receiving space, a phase shifting circuit disposed inside the receiving space, and a dielectric element slidably mounted in the receiving space and parallel with the phase shifting circuit. A rail is disposed on an inner wall of the cavity for preventing contact between the movable dielectric element and the phase shifting circuit.

The rail is disposed on the inner wall of the cavity opposed to the dielectric element; the number of the rail disposed on the inner wall is one; and, a sliding groove is defined in the dielectric element at a location corresponding to the rail for realizing engagement between the rail and sliding groove.

The rails are disposed on a pair of opposed inner walls of the cavity at two sides of the dielectric element; each of the inner wall is provided with the rail; and the dielectric element and the phase shifting circuit are located at two sides of the rail.

The phase shifting circuit includes a phase shifting conductor and a dielectric supporting member for securing the phase shifting conductor and cavity together.

The dielectric supporting member is a circuit board; and the phase shifting conductor is printed on the circuit board.

The phase shifting conductor is a metal plate.

The receiving space extends inside the cavity.

Furthermore, there may be more than one dielectric element inside the cavity.

When there are two dielectric elements, each dielectric element is supported by the rail disposed on an inner wall of the cavity opposed to the dielectric element.

When there are two dielectric elements, each dielectric element is supported by the rails disposed on a pair of inner walls of the cavity.

Furthermore, there are two dielectric elements and two pairs of rails, which are disposed substantially parallel with each other; a holding groove is defined between the two pairs of rails for mounting the phase shifting circuit therein; and each dielectric element is supported by a pair of rails disposed on a pair of inner walls.

Alternatively, there are two dielectric elements and two pairs of parallel rails respectively disposed on two inner walls located just above and below the phase shifting circuit; a sliding groove is defined in the dielectric element at a location corresponding to the rail for realizing engagement between the rail and sliding groove of the dielectric element.

The present invention has the following advantageous effects when compared to prior art:

First, as there are a number of rails provided for the dielectric phase shifter of the invention, contact between the dielectric element and feeding network is prevented. In this case, the feeding network will not be imposed with additional external force, and reliability is high. Moreover, wear of the feeding network and/or dielectric element during operation is eliminated.

Second, the dielectric phase shifter of the invention has the advantages of better electrical performance, high precision of the phase shifting, high linearity, and less passive inter-modulation product.

DETAILED DESCRIPTION OF THE INVENTION

The present invention will be further described below with reference to accompanied drawings and exemplary embodiments. Here, identical numerals represent the identical components throughout the drawings. In addition, detailed description of prior art will be omitted if it is unnecessary for illustration of the features of the present invention.

First Embodiment

Figure 1:
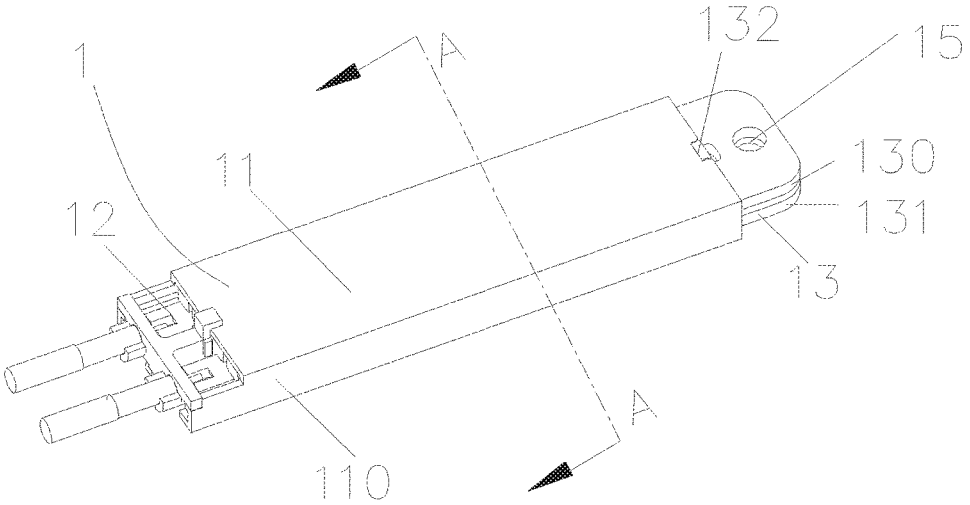
FIG. 1 shows a structural view of a dielectric phase shifter according to a first embodiment of the present invention.
Figure 2:
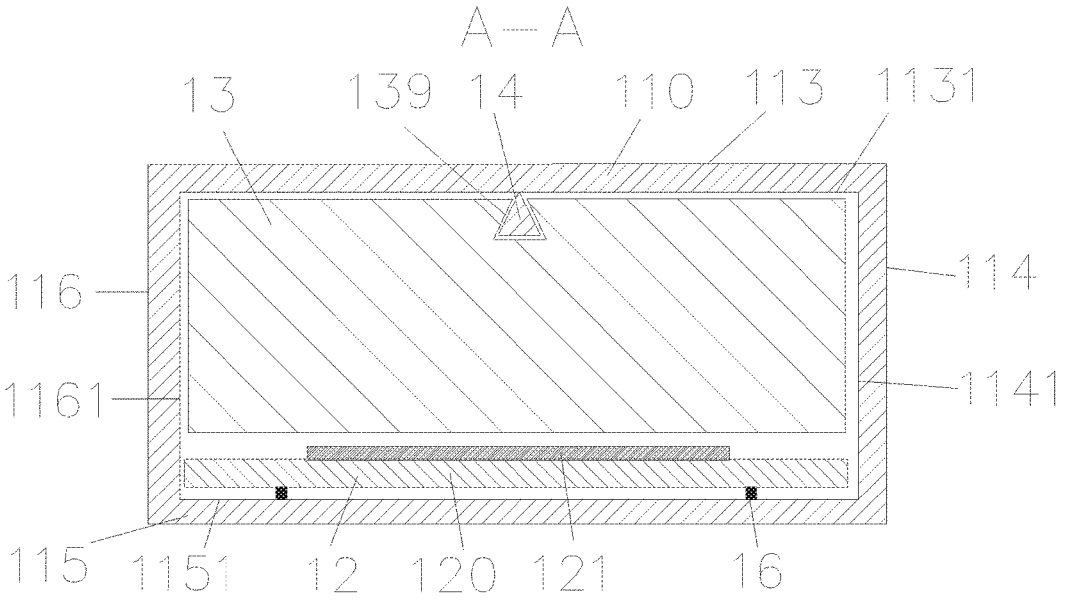
FIG. 2 shows a cross-sectional view of the dielectric phase shifter of FIG. 1 along line A-A.
Figure 3:
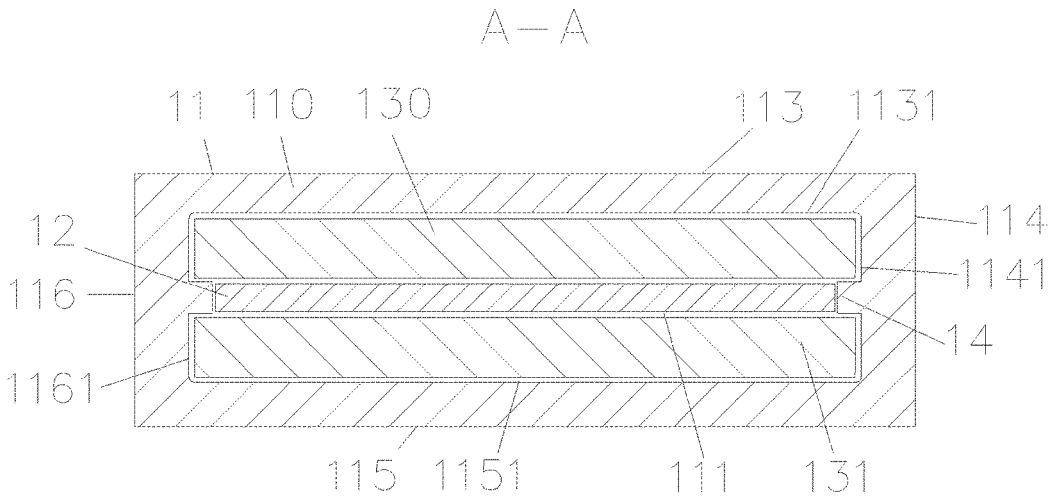
FIG. 3 shows a structural view of a dielectric phase shifter of FIG. 1 along line A-A according to another embodiment of the present invention.

As shown in FIGS. 1-3, a dielectric phase shifter 1 (FIG. 1) of the present invention includes a cavity 11 (FIGS. 1 and 3), a phase shifting circuit 12, a dielectric element 13 (FIGS. 1 and 2), and several rails 14 (FIGS. 2 and 3).

As shown in FIG. 1, the cavity 11 is made of metal using extrusion or die-casting process. The cavity 11 has five enclosing walls 110 including four of which are disposed around the cavity 11 along a longitudinal direction, and a receiving space 111 defined by the five enclosing walls 110. Referring to FIG. 2, the cavity 11 is defined by a top enclosing wall 113, a right enclosing wall 114, a bottom enclosing wall 115, and a left enclosing wall 116 together, the top enclosing wall 113 having a top inner wall 1131, the right enclosing wall 114 having a right inner wall 1141, the bottom enclosing wall 115 having a bottom inner wall 1151, the left enclosing wall 116 having a left inner wall 1161, all these inner walls together define the elongated receiving space 111. One end of the cavity 11 is not provided with any enclosing walls 110 to form an opened end in advance. In addition, the receiving space 111 (FIG. 3) runs inside the cavity 11 to facilitating installation of the phase shifting circuit 12, dielectric element 13 and other components. Moreover, it also facilitates straight movement of the dielectric element 13 along the longitudinal direction of the cavity 11 when imposed by force. Of course, two ends of the cavity 11 along the longitudinal direction may not be provided with any enclosing walls to form opened ends in advance. In other embodiments, the cavity 11 may also be formed by a grooved body (not shown), at least one end of the grooved body is not provided with any enclosing wall to in advance define an opened end, and a cover (not shown) for covering the grooved body.

The phase shifting circuit 12 includes a phase shifting conductor 121 and a dielectric supporting member 120 for securing the phase shifting conductor 121 and cavity 11 together as shown in FIG. 2.

Here, the dielectric supporting member 120 may be a circuit board on which the phase shifting conductor 121 is printed. The circuit board 120 may be a single-layered PCB. That is, the phase shifting conductor 121 may be printed on one side of the PCB 120. Alternatively, it may also be a double-layered PCB. In this case, the phase shifting conductor 121 may be printed on both sides of the PCB 120 (See FIG. 4). The phase shifting conductors 121 located on both sides of the double-layered PCB 120 may be connected with each other by a number of through holes (not shown). One side of the circuit board 120 closest to an enclosing wall 110 is provided with a metal welded member 16 (FIG. 2) welded on the same enclosing wall 110, thus securing the circuit board 120 (the phase shifting circuit 12) into the cavity 11.

In theory, when the two sides of the PCB 120 are equipped with the phase shifting conductors 121 between which no interference is present, for the phase shifter 1, it may be deemed that the receiving space 111, dielectric element 13, and the phase shifting circuit 12 are divided by the PCB 120 into two independent parts, thus defining two independent sub-phase shifters each is able to perform phase shifting to signals passed there through.

In other embodiments, the phase shifting conductor may be a metal conductor of for example metal bar or metal sheet. The metal conductor constitutes the phase shifting conductor following principles of phase shifting circuit, and the phase shifting conductor is secured in the receiving space of the cavity by the dielectric supporting member, as illustrated in a second embodiment.

The cavity 11 of the phase shifter 1 of the present invention accommodates the dielectric element 13 capable of moving straight along the longitudinal direction of the cavity 11. An equivalent dielectric constant of the cavity 11 may be varied by moving the dielectric element 13, hence changing transmission speed of signals inside the phase shifter 1, and thereby continuous linear phase difference for the signal output from the phase shifter 1 being generated. As such, the phase shifting is realized.

The dielectric element 13 of the present invention is preferably elongated and may be made of different kinds of materials. Moreover, dielectric constant of the element $\varepsilon_r>1.0$. In addition to higher dielectric constant, the material of the dielectric element 13 is further required to have low loss angle tangent characteristics. Furthermore, to obtain higher equivalent dielectric constant for the phase shifter 1, the receiving space should be filled by the dielectric element 13 as much as possible.

In case that the dielectric element 13 is in direct contact with the phase shifting circuit 12, for example when the element 13 is directly positioned on the phase shifting circuit 12, an external force will be imposed on the phase shifting circuit 12. In addition, wear will occur to the circuit 12 and/or element 13 during movement of the element 13.

Referring to FIGS. 2-3, to avoid the above problems, at least one rail 14 is disposed inside the cavity 11 of the dielectric phase shifter 1 of the present invention to generate a gap between the dielectric element 13 and the phase shifting circuit 12, thereby preventing direct contact between the dielectric element 13 and the phase shifting circuit 12.

The rail 14 is of an elongated shape, disposed on an inner wall of an enclosing wall 110 along the longitudinal direction of the cavity 11, and extends along the same direction of the cavity 11. The rail 14 may either be integrally formed with the enclosing wall 110 of the cavity 11 or be formed on the inner wall of the enclosing wall 110 of the cavity 11 after formation of the cavity 11.

When there is only one dielectric element 13, the rail 14 is disposed on an inner wall of an enclosing wall 110 opposite to the dielectric element 13. As used herein, the enclosing wall 110 opposite to the dielectric element 13 means the wall which faces a wider end surface of the dielectric element 13. In other words, the top inner wall 1131 or the bottom inner wall 1151 of this enclosing wall 110 is the wall located just above or below the element 13. The rail 14 is disposed on the top inner wall 1131 as shown in FIG. 2. A sliding groove 139 (FIG. 2) is defined in the dielectric element 13 at a location corresponding to the rail 14. The rail 14 locates inside the sliding groove 139 (FIG. 2) of the dielectric element 13 such that the rail 14 is mounted inside the element 13. By this manner, the dielectric element 13 moves straight on the rail 14. In addition, during movement of the dielectric element 13, it will not contact the phase shifting circuit 12 and accordingly, reliability of the phase shifter 1 is improved. The rail 14 may have a cross section of circle, triangle, rectangular, trapezoid or other polygon, as can be configured upon requirement by person of ordinary skill in the art.

With reference to FIG. 23, when there are two rails 14, the two rails 14 may construct a pair of rails of the same shape. The pair of rails 14 are placed on respective inner walls of the enclosing walls 110, located at two lateral sides of the element 13, of the cavity 11. Furthermore, the pair of rails 14 are at the substantially same height on the two enclosing walls 110. The two rails 14 are placed at the same height at the enclosing walls 110 of the cavity 11, due to maybe not strictly rectangular shape of the cavity 11 or manufacture tolerance. However, it should be noted that function of the rails 14 of the present invention may still be achieved through they are not at the same height in a strict manner. Further, it should also be noted that the enclosing walls 110 at two lateral sides of the dielectric element 13 mean that they are substantially parallel with the thickness direction of the element 13. These enclosing walls are different from those opposite to the element 13 as mentioned above.

For the receiving space to be filled with the dielectric element 13 as much as possible, the phase shifting circuit 12 is preferably mounted between the pair of rails 14. As such, the dielectric elements 13 (such as an upper dielectric element 130 and a lower dielectric element 131 as shown in FIGS. 1 and 3) may be disposed above and below the dielectric circuit 12 respectively to obtain the equivalent dielectric constant as great as possible for the phase shifter 1 of the present invention.

To adapt installation of the phase shifting circuit 12, the thickness of each rail 14 should be larger than that of the phase shifting circuit 12 to avoid contact between the dielectric elements 13 supported on the same rail 14 and the phase shifting circuit 12.

Figure 8:
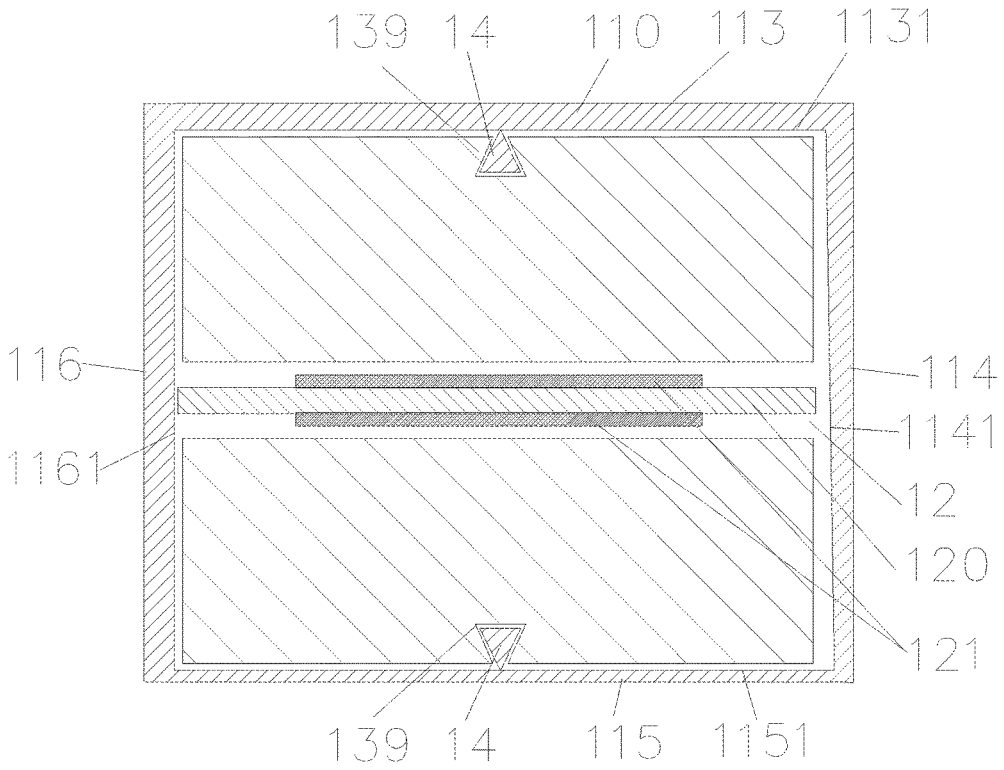
FIG. 8 shows a structural view of a dielectric phase shifter of FIG. 1 according to another embodiment of the present invention.
Figure 9:
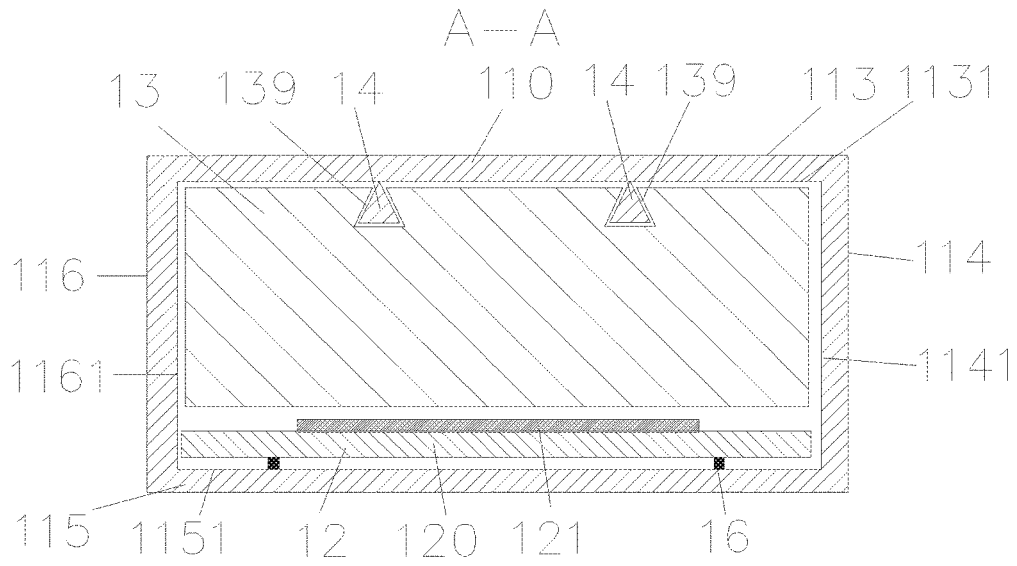
FIG. 9 shows a cross-sectional view of the dielectric phase shifter of FIG. 1 along line A-A according to still another embodiment of the present invention.
Figure 10:
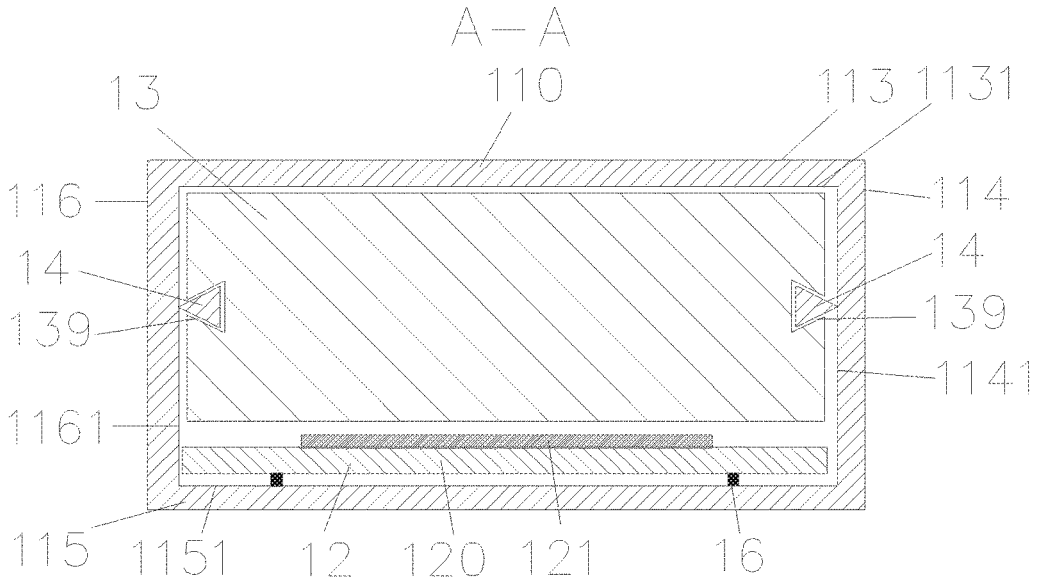
FIG. 10 shows a cross-sectional view of the dielectric phase shifter of FIG. 1 along line A-A according to yet another embodiment of the present invention.

The two rails 14 may also be disposed on the top inner wall 1131 and the bottom inner wall 1151 of the enclosing walls 110 respectively located just above and below the phase shifting circuit 12 as shown in FIG. 8. That is, the dielectric element 13 and rail 14 are assembled together by inserting the rail 14 into the sliding groove 139 of the element 13.

When there are two rails 14 inside the cavity 11, and they locate over and below the phase shifting circuit 12 respectively, the two rails 14 may be different from each other. Arrangement of the rails 14 inside the cavity 11 and shape of the rails 14 may be determined in a manner identical to those of a single rail 14 as discussed above. Description of the same will be omitted herefrom.

Figure 4:
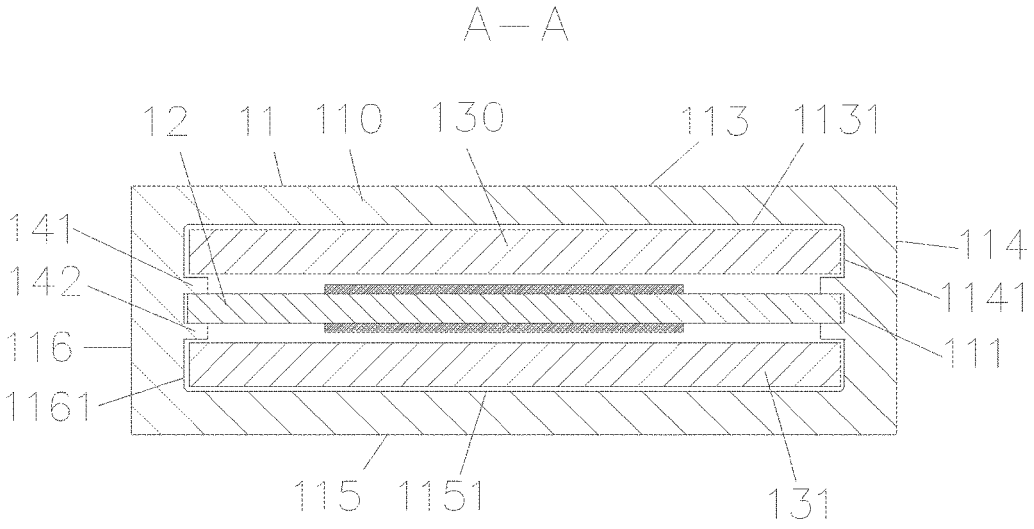
FIG. 4 shows a structural view of a dielectric phase shifter of FIG. 1 along line A-A according to a further embodiment of the present invention.

Referring to FIGS. 3-4, more rails 14 (FIG. 3) may be disposed in the cavity 11 (FIG. 4). For example, two pairs of rails 14 may be presented in the cavity 11. The two pairs of rails 14 are disposed on a pair of lateral enclosing walls 110 (such as the left enclosing wall 116 and the right enclosing wall 114 as shown in FIGS. 3 and 4) at two sides of the element 13 (FIG. 1) in a substantially parallel manner. Moreover, a pair of holding grooves 111 is defined between the two pairs of rails 14 and extends along the longitudinal direction of the cavity 11 for holding the phase shifting circuit 12 therein. The phase shifting circuit 12 is carried on a base plate such as a PCB. The holding groove 111 is intended for holding the base plate of the circuit 12 (the dielectric supporting member 120). As a result, two pairs of rails are provided above and below the phase shifting circuit 12 respectively, (for example the upper rails 141 and lower rails 142 as shown in FIG. 4).

Correspondingly, the dielectric element 13 includes an upper dielectric element 130 disposed on the upper rails 141 and a lower dielectric element 131 disposed on the lower rails 142. Due to the arrangement of the two pairs of rails 14, movement of the dielectric element 13 is restricted, thus avoiding contact between the dielectric element 13 and the phase shifting circuit 12 during movement of the dielectric element 13, and improving inter-modulation and reliability.

Please also refer to FIG. 1. To maintain synchronous movement of the upper dielectric element 130 and lower dielectric element 131, the dielectric element 13 further includes a dielectric element connection member 132. Furthermore, to drive the dielectric element 13 by an external device such as a motor (not shown), the phase shifter 1 of the invention may further include an external force actuation element 15 connected to the dielectric element 13 and disposed at an opened end of the cavity 11.

Person of ordinary skill in the art should understand that the construction of the phase shifting circuit, dielectric element, and rails in this embodiment may be applied to other embodiments. Accordingly, in following embodiments, a certain structure perhaps will not be described and it should not be construed that the phase shifter of the present invention lacks of this certain structure. This can be configured upon requirement by person of ordinary skill in the art for realizing objects of the invention.

Second Embodiment

Figure 5:
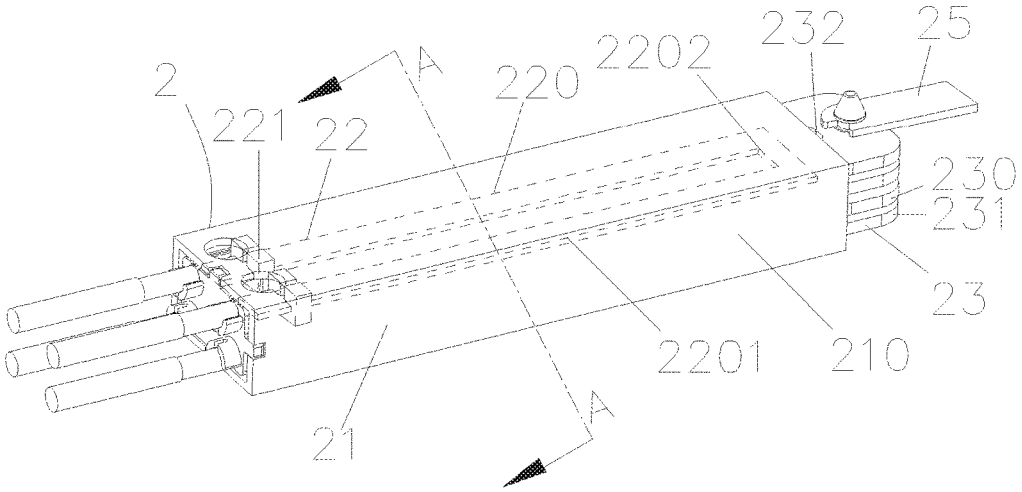
FIG. 5 shows a structural view of a dielectric phase shifter according to a second embodiment of the present invention.
Figure 6:
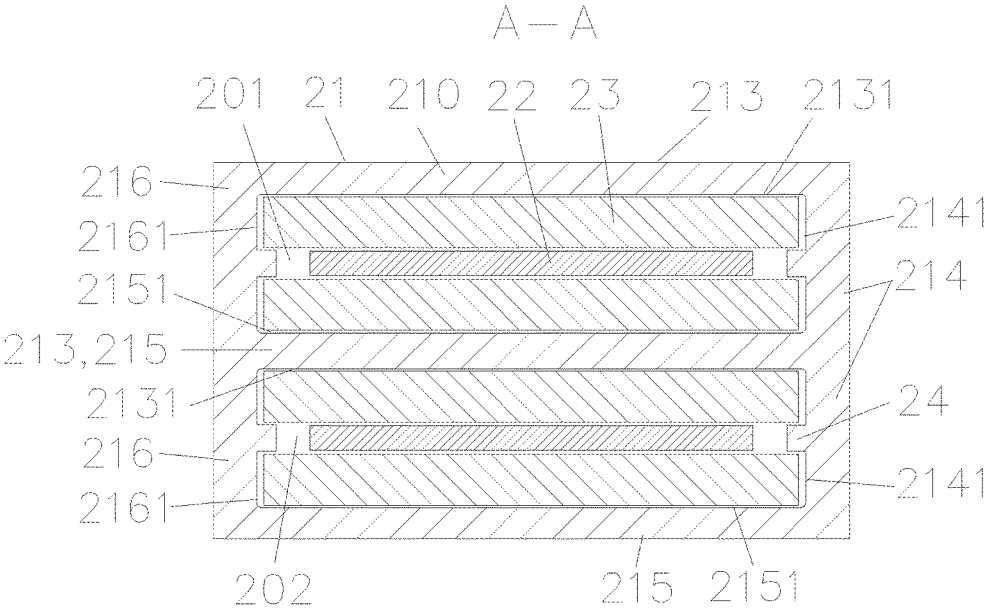
FIG. 6 shows a cross-sectional view of the dielectric phase shifter of FIG. 5 along line A-A.
Figure 7:
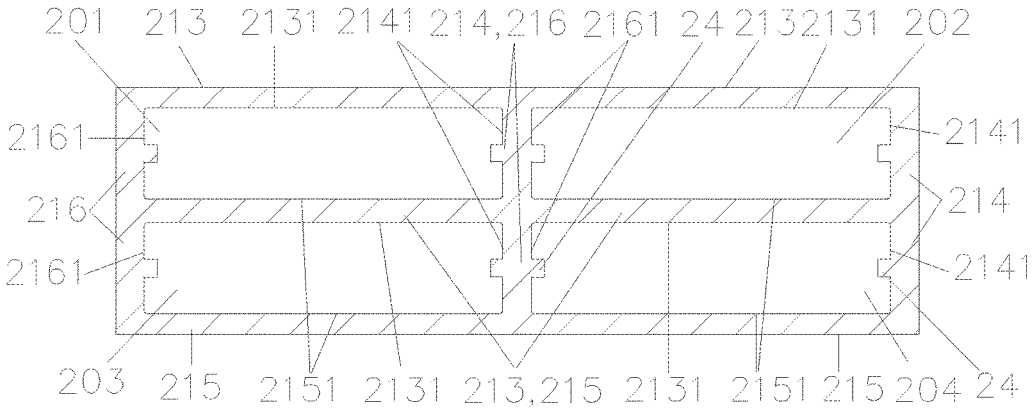
FIG. 7 shows a cross-sectional view of a cavity of another dielectric phase shifter according to the second embodiment of the present invention.

Refer to FIGS. 5-7. The dielectric phase shifter of the present invention is a combinative phase shifter 2 (FIG. 5). As shown in FIG. 6, each of the two cavities 201 and 202 is defined by a top enclosing wall 213, a right enclosing wall 214, a bottom enclosing wall 215, and a left enclosing wall 216 together, the top enclosing wall 213 having a top inner wall 2131, the right enclosing wall 214 having a right inner wall 2141, the bottom enclosing wall 215 having a bottom inner wall 2151, and the left enclosing wall 216 having a left inner wall 2161, all these inner walls together defining an elongated receiving space. The bottom enclosing wall 215 of the elongated receiving space of the cavity 201 coincide with and function also the top enclosing wall 213 of the cavity 202.

Said Each of the receiving spaces is for mounting a phase shifting circuit 22, a dielectric element 23, and other components therein as shown in FIGS. 5 and 6. These spaces also allow straight movement of the dielectric element 23 along a longitudinal direction of the cavity 21. When the same phase shifting circuits 22 are installed into the two receiving spaces respectively, the combined phase shifter 2 works at a same frequency, and it is suitable for a single frequency dual-polarized antenna. When different phase shifting circuits 22 are installed into the two receiving spaces respectively, the combined phase shifter 2 may work at different frequency, and it is suitable for a multiple-frequency antenna.

Similar to the first embodiment, in the second embodiment, each of the cavities 201 and 202 is constructed of multiple enclosing walls 210 (as mentioned above). Inside the receiving space, the phase shifting circuit 22 is disposed. The dielectric element 23 is disposed between the phase shifting circuit 22 and enclosing walls 210 as shown in FIGS. 5 and 6.

The phase shifting circuit 22 includes a phase shifting conductor made of a metal conductor 220 (FIG. 5) according to principle of phase shifting circuit, and a dielectric supporting member 221 (FIG. 5) for securing the metal conductor 220 into the cavity 21. The metal conductor 220 is bent to define a substantially U-shaped configuration, and includes two straight arms 2201 and a base portion 2202 by which the two arms 2201 are joined together as shown in FIG. 5. An end portion of each straight arm 2201 far away from the base portion 2202 is for connecting a transmission cable (not labeled) as shown in FIG. 5.

Please see FIG. 6. To avoid direct contact between the phase shifting circuit 22 and dielectric element 23, a rail 24 is disposed between the phase shifting circuit 22 and dielectric element 23, thereby preventing direct contact between the element 23 and circuit 22.

A pair of rails 24 is contained in the receiving space of each of the cavities 201 and 202 as shown in FIG. 7. The pairs of rails 24 are at the substantially same height on corresponding inner walls of the enclosing walls 210. The height of the rails 24 is larger than the thickness of the phase shifting circuit 22 as shown in FIG. 5. The phase shifting circuit 22 is disposed between the pair of rails. In addition, the dielectric elements 23 for example an upper dielectric element 230 and a lower dielectric element 231 are located just above and below the circuit 22 as shown in FIG. 5.

To facilitate straight movement of the dielectric element 23 along the longitudinal direction of the cavity, the phase shifter 2 may further include an external force actuation element 25 as shown in FIG. 5. Moreover, to maintain synchronous movement of the upper dielectric element 230 and lower dielectric element 231, the dielectric element 23 further includes a dielectric element connection member 232 as shown in FIG. 5.

Please refer to FIG. 7 showing a cross section of another phase shifter of the second embodiment. This phase shifter 2 is constructed of four cavities 201, 202, 203, and 204, which are juxtaposed vertically and laterally. The cavity 201 is defined by a top enclosing wall 213, a right enclosing wall 214, a bottom enclosing wall 215, and a left enclosing wall 216 together, the top enclosing wall 213 having a top inner wall 2131, the right enclosing wall 214 having a right inner wall 2141, the bottom enclosing wall 215 having a bottom inner wall 2151, the left enclosing wall 216 having a left inner wall 2161, all these inner walls together defining the elongated receiving space. The right enclosing wall 214 of the elongated receiving space of the cavity 201 coincides with the left enclosing wall 216 of the elongated receiving space of the cavity 202. The bottom enclosing wall 215 of the elongated receiving space of the cavity 201 coincides with the top enclosing wall 213 of the elongated receiving space of the cavity 203. The bottom enclosing wall 215 of the elongated receiving space of the cavity 202 coincides with the top enclosing wall 213 of the elongated receiving space of the cavity 204. The right enclosing wall 214 of the elongated receiving space of the cavity 203 coincides with left enclosing wall 216 of the elongated receiving space of the cavity 204.

Each sub-phase shifter (for example 204) has a pair of rails 24 contained therein, and the pair of rails 24 is at the substantially same height on the corresponding inner walls of two opposed enclosing walls 210.

In addition, as to arrangement and configuration of the dielectric element 23 and rails 24 inside each sub-phase shifter, including number, shape, structure, and location of the dielectric element and rails, reference may be made to the first embodiment and accordingly, here they will not be repeated again.

In a summary, by providing a number of rails inside the cavity of the phase shifter, and causing movement of the dielectric element along the rails relative to the cavity and the phase shifting circuit, phase shifting is achieved for a signal inside the phase shifter. The electrical and physical characteristics of the phase shifter are significantly enhanced due to prevention of direct contact between the dielectric element and the phase shifting circuit.

Though various embodiments of the present invention have been illustrated above, a person of ordinary skill in the art will understand that, variations and improvements made upon the illustrative embodiments fall within the scope of the present invention, and the scope of the present invention is only limited by the accompanying claims and their equivalents.

The invention claimed is:

1. A dielectric phase shifter, comprising a cavity having an elongated receiving space, a phase shifting circuit disposed inside the receiving space, and two dielectric elements slidably mounted in the receiving space and parallel with the phase shifting circuit, the cavity being defined by a top enclosing wall, a right enclosing wall, a bottom enclosing wall, and a left enclosing wall together, the top enclosing wall having a top inner wall, the right enclosing wall having a right inner wall, the bottom enclosing wall having a bottom inner wall, and the left enclosing wall having a left inner wall, wherein the top inner wall, the right inner wall, the bottom inner wall and the left inner wall together defining the elongated receiving space; wherein two rails are disposed on the top inner wall and bottom inner wall of the cavity respectively; and two sliding grooves are defined in the two dielectric elements respectively at locations corresponding to respective rails on the top inner wall and the bottom inner wall for realizing engagement between the respective rails and corresponding sliding grooves of the dielectric elements.

2. A dielectric phase shifter, comprising: a cavity having an elongated receiving space; a phase shifting circuit disposed inside the receiving space; two dielectric elements slidably mounted in the receiving space and parallel with the phase shifting circuit; and two pairs of parallel rails, each pair of parallel rails being disposed at the left and right inner walls of the cavity respectively; wherein the cavity is defined by a top enclosing wall, a right enclosing wall, a bottom enclosing wall, and a left enclosing wall together; the top enclosing wall has a top inner wall, the right enclosing wall has a right inner wall, the bottom enclosing wall has a bottom inner wall, and the left enclosing wall has a left inner wall, wherein the top inner wall, the right inner wall, the bottom inner wall and the left inner wall together defining the elongated receiving space; a pair of holding grooves is defined between the two pairs of rails for mounting the phase shifting circuit therein; one of the two dielectric elements is supported by one of the two pairs of rails, and the other one of the two dielectric elements is supported by the other one of the two pairs of rails.

3. A dielectric phase shifter, comprising a cavity having an elongated receiving space, a phase shifting circuit disposed inside the receiving space, and a dielectric element slidably mounted in the receiving space and parallel with the phase shifting circuit, the cavity being defined by a top enclosing wall, a right enclosing wall, a bottom enclosing wall, and a left enclosing wall together, the top enclosing wall having a top inner wall, the right enclosing wall having a right inner wall, the bottom enclosing wall having a bottom inner wall, and the left enclosing wall having a left inner wall, wherein the top inner wall, the right inner wall, the bottom inner wall and the left inner wall together defining the elongated receiving space; wherein a rail is disposed on the top inner wall of the top enclosing wall of the cavity for preventing contact between the movable dielectric element and phase shifting circuit; and a sliding groove is defined in the dielectric element at a location corresponding to the rail for realizing engagement between the rail and sliding groove.

4. The dielectric phase shifter as recited in claim 3, wherein the phase shifting circuit includes a phase shifting conductor and a dielectric supporting member for securing the phase shifting conductor and cavity together.

5. The dielectric phase shifter as recited in claim 4, wherein the dielectric supporting member is a circuit board; and the phase shifting conductor is printed on the circuit board.

6. The dielectric phase shifter as recited in claim 4, wherein the phase shifting conductor is a metal plate.

7. The dielectric phase shifter as recited in claim 3, wherein the receiving space extends inside the cavity.

8. The dielectric phase shifter as recited in claim 3, wherein the cavity is integrally formed with the rail.

* * * * *